United States Patent [19]

Kretschmer et al.

[11] 4,213,217

[45] Jul. 22, 1980

[54] PROCESS FOR CONTINUOUSLY WASHING A PRINTED TEXTILE SHEET-LIKE STRUCTURE

[75] Inventors: Alfred Kretschmer; Wilhelm Ruettiger, both of Ludwigshafen; Albrecht Wuerz, Maikammer, all of Fed. Rep. of Germany

[73] Assignee: BASF Aktiengesellschaft, Fed. Rep. of Germany

[21] Appl. No.: 971,233

[22] Filed: Dec. 20, 1978

[30] Foreign Application Priority Data

Dec. 24, 1977 [DE] Fed. Rep. of Germany ..... 2757988

[51] Int. Cl.[2] ..... D06B 3/10

[52] U.S. Cl. ..... 8/151; 68/22 B

[58] Field of Search ..... 8/151, 156, 158; 68/22 R, 22 B

[56] References Cited

U.S. PATENT DOCUMENTS

| | | | |
|---|---|---|---|
| 3,449,060 | 6/1969 | Schenck | 8/151 X |
| 3,451,077 | 6/1969 | Meier-Windhorst et al. | 8/151 |
| 4,095,947 | 6/1978 | Wolf et al. | 8/158 X |

FOREIGN PATENT DOCUMENTS

| | | | |
|---|---|---|---|
| 1384759 | 11/1964 | France | 68/22 B |
| 1089174 | 11/1967 | United Kingdom | 68/22 R |

*Primary Examiner*—Philip R. Coe

*Attorney, Agent, or Firm*—Keil & Witherspoon

[57] ABSTRACT

A process for continuously washing a printed textile sheet-like structure, wherein water or a wash liquor is applied to the goods so that they entrain from 80 to 500% of water, based on the weight of the goods, the goods are then squeezed off between rollers so as to remove at least 30% of water, based on the weight of the goods, and the surface-swollen print paste residues are transferred from the goods to the roller, from which they are removed by means of water. The treatment can be repeated one or more times, and a conventional after-wash can be carried out if appropriate. The process is cheaper than conventional processes and only slightly affects the color of the unprinted areas.

4 Claims, 6 Drawing Figures

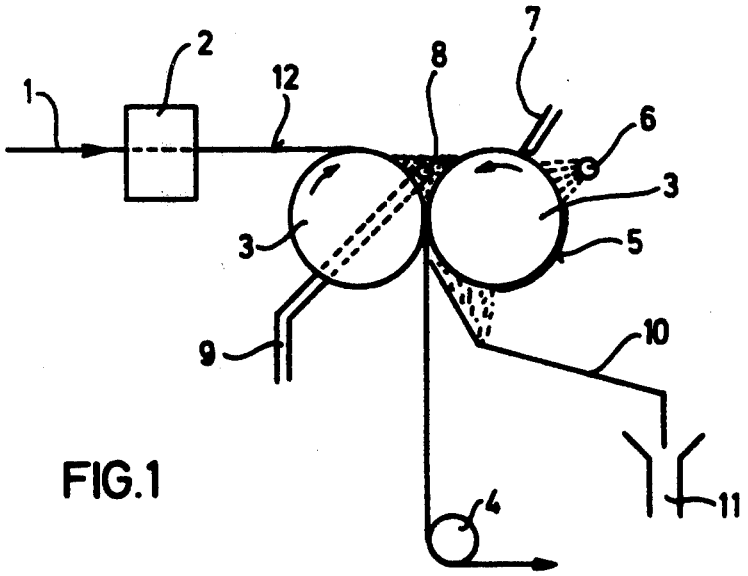
FIG.1
FIG.2
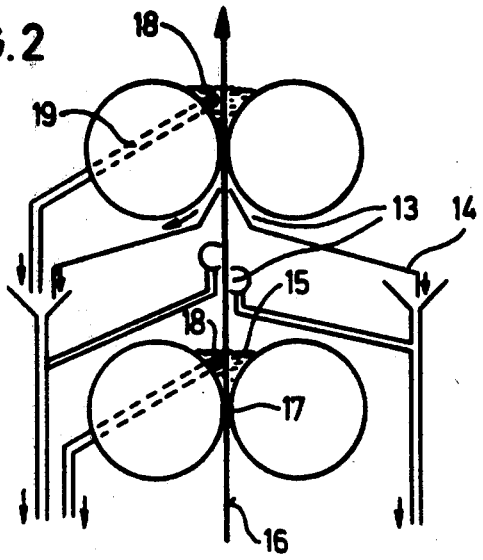

Dye concentration in the wash liquor
C
mg/e
800
700
600
500
400
300
200
100
0

-3g/kg
-2g/kg
-1g/kg
0
1.
2.
3.
4.
Treatment stage
≈10g/l
≈5g/l
<2g/l
2g/l
Concentration of thickener in the wash liquor

PROCESS FOR CONTINUOUSLY WASHING A PRINTED TEXTILE SHEET-LIKE STRUCTURE

The present invention relates to a process for continuously washing a printed textile sheet-like structure.

It is conventional practice in industry to afterwash printed textile material in order to remove unfixed dye, thickeners and assistants from the printed material. The washing out of thickeners presents a particular problem, because the heat exposure entailed in fixing the dyes greatly impairs the digestibility, dispersibility, swellability and solubility of the thickener. An additional problem in the afterwashing of printed textile materials is that washing conditions under which the unfixed residual dye would be absorbed on the white background of the printed material must not be used to remove the thickeners. It is therefore understandable that the afterwashing is carried out by means of processes which are very slow and consume a large amount of water. At the present time, printed textile materials are afterwashed by a method entailing a high throughput of water and the application of hydraulic energy, namely by spraying the goods or by subjecting them to an intense transverse or tangential flow. The availability of a large amount of water is essential so as to remove any unfixed dye without staining, and also in order to digest, and remove, thickeners. Residual dye and thickener very substantially detract from the quality of the printed textile material in respect of hand and drape, and from the fastness characteristics, especially the wet and dry crock fastness, fastness to perspiration and fastness to processing, i.e. fastness to staining of the ground of the washed wet textile material on the beam or in plaited form, directly after the washing process, while suspended in festoons before drying. In addition, remnants of thickeners on the textile material reduce the scuff resistance after resin finishing and the unfixed dyes and/or the residual dyeing assistants frequently cause changes in hue in the printed textile material.

The present invention seeks to provide an improved process for afterwashing printed textile material so that less energy and less water is required for the washing process, and that the process can be carried out more rapidly and in smaller installations.

According to the present invention there is provided a process for continuously washing a printed textile sheet-like structure, wherein water or an aqueous wash liquor is applied to the sheet-like structure so that it takes up from 80 to 500% by weight of water based on the weight of the sheet-like structure, and the sheet-like structure is then squeezed off against a squeeze roller or rollers so as to remove at least 30% by weight of water based on the weight of the sheet-like structure, whereby removable material on the surface of the sheet-like structure is transferred from the sheet-like structure to the squeeze roller(s), from which it is then removed, e.g. by means of water, after which the goods may or may not be afterwashed. Preferably, the textile sheet-like structure takes up from 150 to 400% by weight of water in the first step.

Whilst the conventional processes require long immersion times of the printed goods in the wash liquor, and it is stated to be inadvisable to squeeze off surface-swollen printed goods, i.e. goods which have swollen in insufficient depth, because this would press residual print paste, auxiliaries and dye into the white ground, the squeezing-off of the surface-swollen printed goods in the process according to the invention surprisingly detracts little, if at all, from the whiteness of the background of the goods.

All textile sheet-like structures which have been printed and on which the dyes have been fixed can be treated by the process of the invention. For the purposes of the invention, the textile sheet-like structures (otherwise referred to as textile material or goods) may be woven fabrics, knitted fabrics or nonwovens. They may consist of natural fibers or synthetic fibers, e.g. wool, cotton, polyester, polyacrylonitrile, nylon, secondary cellulose acetate and cellulose triacetate fibers, or of fiber mixtures.

The textile sheet-like structures may be printed by conventional processes, using commercial print pastes. These contain dyes specific for the various fibers, e.g. reactive dyes, disperse dyes, vat dyes, sulfur dyes, acid dyes, fixing dyes and cationic dyes, and, in every case, a natural and/or synthetic thickener, with or without further assistants, e.g. dispersants, emulsifiers, anti-foam agents and the like.

To remove residual print paste, thickener, unfixed dye and other assistants from a fixed printed textile sheet-like structure, the latter is treated with water or an aqueous wash liquor so that it takes up from 80 to 500% by weight of water based on the weight of the sheet-like structure. The water or wash liquor may be applied to the sheet-like structure by, for example, dipping, spraying or slop-padding. This step can be carried out very rapidly; for example, immersion times of less than 15 seconds are fully adequate in a dipping operation. The charging of the sheet-like structure with water, which is always carried out on the open-width sheet, i.e. not on rope, can be carried out in an energy-saving manner, at room temperature. If the sheet-like structure wets badly, especially in the printed areas, a wash liquor which, for example, contains a quick-acting conventional wetting agent may be used. Examples of wetting agents are surfactants obtained by adduct formation of ethylene oxide with fatty alcohols or fatty amines. The wash liquors may contain nonionic, anionic or cationic wetting agents or mixtures of nonionic and anionic, or cationic and nonionic, wetting agents. It is also possible to use as wash liquors dilute solutions of dispersants in water, and conventional detergent solutions. Examples of conventional dispersants are condensation products of formaldehyde and $\beta$-naphthalenesulfonic acid, and ligninsulfonates. As a rule, the wash liquors contain up to 1% by weight of the said additives. In the case of print paste films which are difficult to digest, especially films which have acquired a horny consistency, it may be times be necessary to add a small amount of an acid or alkali to the wash liquor. Examples of suitable acids are acetic acid, formic acid and sulfuric acid. Examples of bases which may be used are sodium hydroxide solution, potassium hydroxide solution and ammonia. Wash liquors which contain non-foaming or low-foaming dispersants give better results in the process according to the invention than does pure water. This also applies in cases where water-soluble thickeners have to be removed from printed textile material and the material has been subjected to relatively severe conditions during fixing.

The process according to the invention can for example be carried out at from 5° to 95° C., preferably at from 10° to 60° C. When charging the textile material with water care should be taken to ensure that the material is wetted everywhere. Thorough wetting of the material can be achieved by using a wash liquor containing wetting agents or, when using pure water, raising the temperature of the water if necessary.

When the water has been applied, a swelling process commences. Following the take-up of the water, the textile sheet-like structure, in open width, is squeezed off against one or more squeeze rollers. The desired resulting wet pick-up after this squeezing off is within the range achieved on conventional padders, viz. from 50 to 120%, preferably from 50 to 90%, by weight based on the weight of the textile material, with the more open textile material requiring higher values in this range. The amount of water with which the goods were charged originally must be sufficiently high for at least 30% by weight of water, based on the weight of the goods, to be present for squeezing off. The material removed from the textile material and suspended in the water is discharged together with the water squeezed off. During squeezing-off, the layer of thickener on the surface of the textile material is evidently sheared off the textile material, and the film of thickener is broken open, because of the fact that its surface adheres to the squeeze roller, and as a result of this transfer is carried off the printed textile surface. In many cases, this transfer is directly observable, when carrying out the process, in that a deposit, in the form of a print pattern, is formed on the squeeze roller. The deposits of the transferred material on the roller may be rinsed or sprayed off the roller with water to which surfactants or dispersants may be added; the water used for this cleaning operation can be recycled until it contains a relatively large amount of the materials being removed. In the case of films which adhere firmly to the squeeze roller it is advantageous to provide mechanical assistance for their removal, for example by means of a wiper or brush. The swollen material (print paste residues such as thickener and unfixed dye) removed from the roller can however also be discharged together with the water squeezed off. The textile material leaving the nip may or may not be after-washed or fed to other processes, e.g. a drying process or a wet-on-wet resin finishing process. The squeeze rollers are preferably conventional steel rollers or rubber rollers. The nip may also be formed by a rubber roller plus a steel roller. The rollers can have a smooth surface or, where necessary, a structured surface, as is the case, for example, with Roberto rollers.

The water removed from the sheet-like structure can be reused as countercurrent water or cleaning water for the rollers, until it is charged with a relatively large amount of impurities.

If the two important process steps, namely charging the textile sheet-like structure with water and squeezing off, are each carried out once, it generally proves possible to remove from 20 to 50% of the unfixed products from the goods. For some purposes this may suffice. If more extensive removal of the unfixed products is required, the above two process steps can be repeated one or more times. For this purpose the textile sheet-like structure is charged, before any afterwashing or further treatment, with from 100 to 300% by weight of water, and is then squeezed off against one or more rollers to a wet pick-up of from 50 to 120% by weight. These percentages are each based on the weight of the sheet-like structure. Depending on the required quality of the structure, these process steps can be repeated one or more times, e.g. 4 times.

IN THE DRAWINGS

FIG. 1 is a diagrammatic sketch of equipment which can be used in carrying out the present invention;

FIG. 2 is a diagrammatic sketch of a further embodiment of the invention in which multiple squeeze-off units are arranged one above the other.

Figure 3:
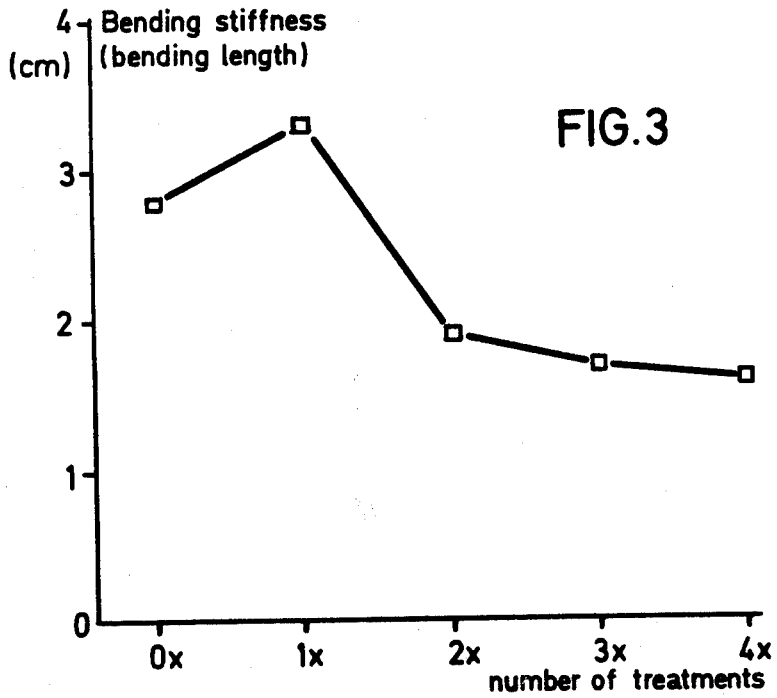
FIGS. 3 to 6 are diagrams setting forth the results of various tests of the effectiveness of the present invention.

Preferably, the process of the invention is carried out by directly removing the film, transferred onto the squeeze roller, from the said roller by conventional cleaning methods, e.g. involving stripping or spraying with water, whilst ensuring, by means of a separating device, that the water sprayed onto the roller does not mix with the water squeezed off the textile material. The cleaning water applied to the roller can be recycled and need only be renewed when rather heavily charged with dye and/or with thickener. This embodiment of the process according to the invention is shown diagrammatically in FIG. 1 of the accompanying drawings. In this Figure, a dry textile web (1) is charged with water in a first process step (2) and is then squeezed off in a padder (3). It then runs continuously via a guide roller (4) to a further process step, e.g., an afterwash or a drying operation. As shown in FIG. 1, a film (5) forms on one roller and is removed by spraying with water (6). A doctor blade (7) prevents the water sprayed on the roller from mixing with water in the gusset (8). The squeezed-off water is removed from the gusset by means of an overflow (9). As mentioned above, the water sprayed onto the film-laden roller (5) is recycled to a certain degree. It passes via a deflector plate (10) and a line (11) into a vessel from which it is either recycled or discarded. The printed side of the textile material is marked (12) in FIG. 1.

If the steps essential to the invention, viz. charging the textile material with water and squeezing off, are carried out repeatedly, the water squeezed off the material in the first treatment stages is heavily contaminated with the impurities to be removed (e.g. residual dye, thickener and assistants) and very little of it should become admixed to the charging water which is fed in. This desired separate removal of the squeezed-off water is most simply achieved by means of squeeze-off units in which the path of the goods, and the arrangement of the squeeze rollers, are such that the water squeezed off can be separately fed into a drain line by gravity (with or without the aid of an overflow).

If cascades of horizontal squeeze-off units, arranged one above the other in the manner of a calender, as shown in FIG. 2 of the accompanying drawings, are available, it is advisable to run the textile goods upward through these and to attempt to trap, to the maximum extent, the squeezed-off water (13), running back along the goods and the rollers, by means of conventional devices (for example with the aid of stripper plates (14), slotted rollers and the like). With this arrangement it has proved somewhat more advantageous to feed the charging water (15) only onto the printed side (16) of the textile goods in the nip (17) and to draw the waste water (18) off the nip, on the opposite side, by means of an overflow (19). This arrangement is illustrated in FIG. 2. In this embodiment of the process according to the invention it is again possible to clean the rollers additionally by spraying water onto the roller which comes into contact with the printed side of the textile web. Preferably, the product to be washed out is removed with the water which runs back from the nip, i.e. the substantial separation, described above, of the charging water, which may or may not contain wetting agent or dispersant, and the squeezed-off water at the nip is carried out very thoroughly.

Only very small amounts of water are used in the process according to the invention as compared to conventional after-washing processes. The consumption of wash water in the process according to the invention is about 1 liter of water/kg of textile goods, i.e., lower by from 1 to 2 orders of magnitude than in the conventional processes for removing thickeners. In the process according to the invention there is at most a slight staining of the white ground, but virtually no bleeding of the contours, as can be observed with the conventional processes. In the process according to the invention, in which the film of thickener is broken open by adhesion to the rollers as well as by the milling energy and compressive energy, even the swelling of excessively dried and partially horny films of thickener is substantially accelerated. In many cases, dwell times of the order of 1 second therefore suffice for successful operation of the process.

The criteria for objectively deciding the required number of repeats of the steps according to the invention are the degree of stiffening (measured by the cantilever method), the fastness characteristics (crockfastness and wetfastness as defined in standard specifications) and the speed of washing out unfixed dye, for example as determined by Lamm's laboratory method. Surprisingly, it has been found that the speed with which unfixed residual dye is washed out of goods treated according to the invention is substantially greater than in conventional washing processes. In particular there is an improvement in washing out residues of dyes whose substantivity decreases with increasing temperature, e.g. direct dyes, hydrolyzed reactive dyes and leuco vat dyes, because, in the process of the invention, washing can be carried out extremely hot, and hence rapidly, directly after the treatment according to the invention, without risk of staining the white background.

Even in the case of dye-textile systems where the dye is absorbed hot, e.g. in the case of polyester/disperse dye systems, a clean white ground is obtained substantially more reliably if, directly after the treatment according to the invention, reducing agent, alkali and dispersant are added cold to the goods and the system is then heated up and passed through the final stage of the washer in the conventional manner.

The Examples which follow, and in which parts and percentages are by weight, illustrate the invention.

EXAMPLE 1

A caustic-boiled 66/33 cotton/polyester fabric weighing 57 g/m$^2$, and 0.22 mm thick, was printed, by a prior art method, over about 70% of its area, with a print paste which contained 70 g/kg of the dye of the formula

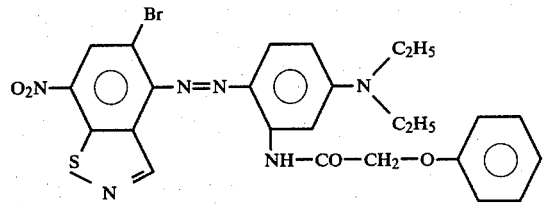

10 g/kg of the dye of the formula

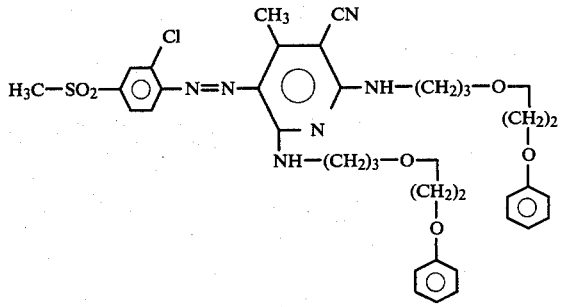

and 165 g/kg of a thickener mixture comprising a locust bean ether thickener, a starch ether thickener and an alginate thickener.

The two-stage process was used, the fabric being charged, in the first stage, with 10% of polyethylene glycol having a molecular weight of 300, and fixing after printing being carried out in 1 minute at 210° C. In the printed zones, the weight per unit area was about 10% higher than that of the white ground.

These goods were dipped, at a speed of 10 m/minute, into water at room temperature (about 20° C.) contained in a trough having a guide roller, and were passed from above into a squeeze-off nip, with half wrap-around on one roller. The distance from the point of immersion of the goods to the nip was 50 cm and the time for wetting and swelling was 3 seconds. The very open goods used showed good wetting even after travelling a short distance from the point of immersion. The amount of liquor entrained by the goods in this method of operation averaged about 5 liters of water per kg of goods (the goods in total entrained 500% of water). The pore or interspace volume of this open fabric was 2.6 liters/kg, so that about 2.5 liters/kg of externally adhering water were entrained.

The horizontal padder used as the squeeze-off unit has 2 rubber-covered driven rollers of 15 cm diameter, the rubber being of Shore hardness 78. The linear contact force was about 10 daN/cm, corresponding to a pressure of about 9 daN/cm$^2$.

A deposit built up on the rollers and, from a visual assessment, reached a constant value after only a short period of running. This deposit could be rubbed off effortlessly, ie. without exerting a high pressure, by means of a wet cloth.

The wash water squeezed off, and building up in the nip, stood about 2 cm high in the nip and was removed through an overflow. The amount of water thus collected averaged about 4 l/kg over a period of time, ie. averaged 400%.

This wash liquor, kept separate from the charging water, was analyzed. It contained 800 mg/l of dye and about 10 g/l of print thickeners and assistants, which could be precipitated with acetone.

A sample of the goods taken downstream from the nip showed, after drying, a weight loss of 4.5% which, bearing in mind the accuracy of measurement achievable in such experiments (which are affected by shrinkage of the goods and differences in moisture content after conditioning) agreed very well with the amounts of product found analytically in the wash water.

Photometric analysis of the wash liquor (after dilution with an 8:2 mixture of acetone and water) showed that the liquor contained 0.8 g/l of dispersed dye, the extinction of the dye being determined as E=10, (by employing a calibration series at 595 nm, for 1 g/l and 1 cm layer thickness). From the said loading and from the mean amount of wash water used, namely 4 l/kg, it follows that the amount of insufficiently fixed dye removed is 3.2 g/kg, i.e. about 10% of the dye applied during printing.

However, the sample thus obtained also exhibited the known disadvantages, ie. greater stiffening-up than that of the untreated goods, and a heavily stained and in part blotchy white background of the goods.

As a result of the very intensive loosening of the unfixed or insufficiently fixed dye, and its partial shift onto the white background, a substantially worse result was also obtained in the perchloroethylene test (3×3 cm fabric sample, shake for 5 minutes in 9 ml of perchloroethylene) for unfixed dye; the dye concentration in the perchloroethylene was 30% higher than in the case of printed goods which had not been after-treated.

After leaving the goods for about 400 seconds, this time being determined by the available working facilities, the treament was repeated on the same equipment, with the same geometry and the same squeeze-off pressure setting, and again using fresh water as the wash water.

The amount of fresh water entrained in this case averaged only 3.5 l/kg of textile goods (350%). The amount of wash liquor removed from the gusset overflow, viz. about 3.5 l/kg of textile goods, was about the same as the amount of fresh water entrained. The wash liquor separated off contained about 0.6 g/l of dispersed dye and about 5 g/l of thickener, which could be precipitated with acetone.

The deposit formed on the rollers by the thickener was more transparent and obviously slighter than in the case of the first treatment. This deposit again did not build up to an objectionable degree with long runs and was easily removable from the running roller by means of a moist sponge.

The weight loss of the printed goods as a result of the treatment according to the process of the invention at this stage amounted to 9.5%, ie. the greater part of the assistant applied during printing had already been removed. The white ground was also brightened and completely free from the cloudy blotches which showed clearly after the first passage. Equally, no marking-off of the deep blue pattern onto the white ground as a result of passing through the unit was detectable. The stiffening-up of the goods also decreased greatly. The stiffness measurement of the cantilever method (41.5° bending secant angle) gave the following values, which were fully confirmed by an assessment of the hand of the fabric:

| | Bending length C in cm | Bending rigidity G in g · m |
|---|---|---|
| Goods printed and fixed | 2.8 | $13 \times 10^{-4}$ |
| Goods treated once | 3.3 | $23 \times 10^{-4}$ |
| Goods treated twice | 1.9 | $4 \times 10^{-4}$ |

The perchloroethylene test for insufficiently fixed dye at this stage gave acceptable values and the concentration of dye (determined photometrically) in the perchloroethylene was only half as great as after the first treatment.

Figure 5:
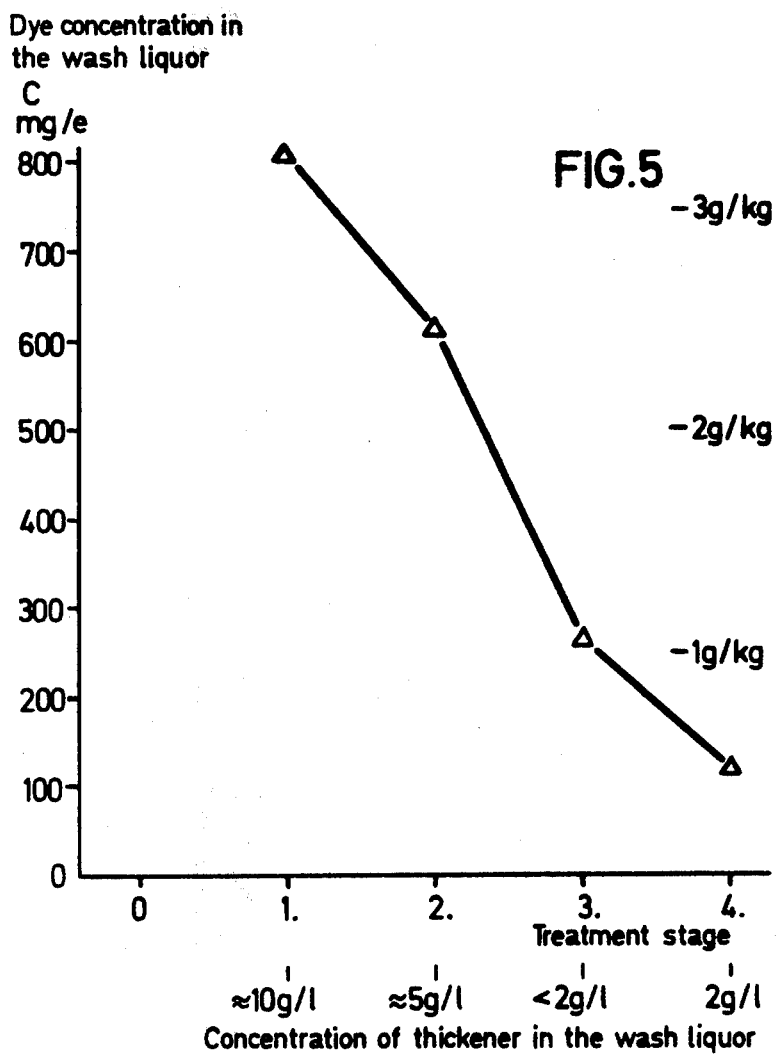
Figure 6:
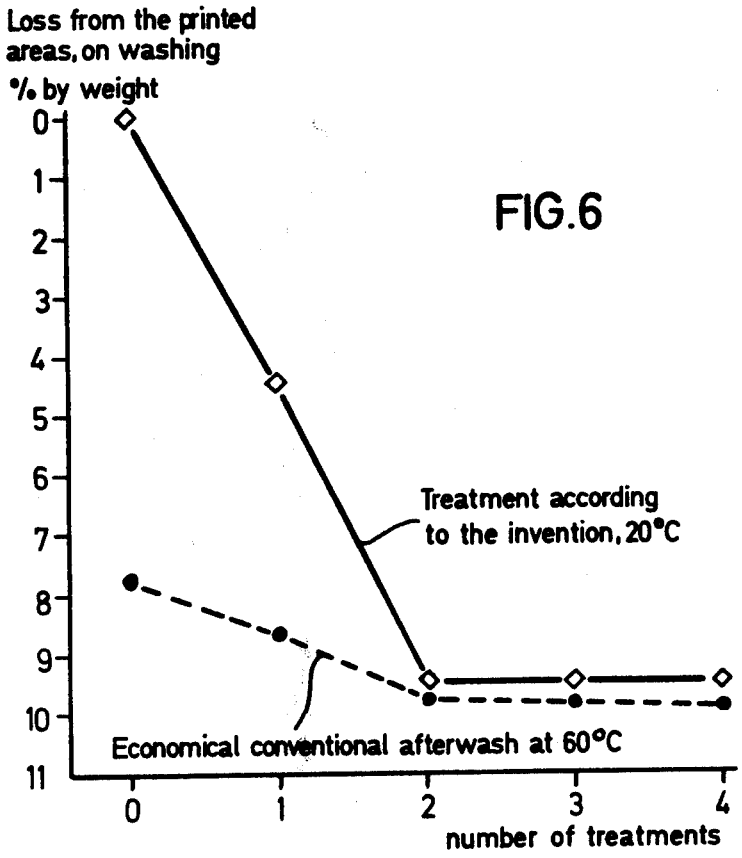

After leaving the goods for about 200 seconds, this time being determined by the available working facilities, the treatment was repeated twice. The results thereby obtained are plotted in the diagrams which follow. These show the assessment of the stiffness (FIG. 3), the result of the perchloroethylene test (FIG. 4), the removal of unfixed dye (FIG. 5) and the total amount of material removed (FIG. 6).

Though in this case some properties of the goods deteriorate after the first treatment, an unforeseeable, substantial improvement in the properties of the goods is achieved from the second treatment onward.

In respect of the hand of the goods, the softness and the flowing drape, a 3rd and 4th treatment produce hardly any further improvement; the same is true of the perchloroethylene test. The wetfastness characteristics, especially the wet crock fastness, on the other hand continue to improve after the 3rd treatment, which is also readily understandable on examining the diagram which shows the removal of unfixed dye by means of the wash water.

This diagram can also be used successfully to select the couter-current flow of the wash water. Experiments using the wash water from the 4th treatment stage as the charging water in the first stage gave results virtually as good as with fresh water, whilst using the wash water from the second stage as the charging water for the first stage produced a decrease of only about 20–30% in the amount of material removed.

Since the treatment according to the invention does not constitute an afterwash in the true sense, untreated samples, and samples treated in accordance with the invention, were subjected to a conventional afterwash, but using a very small amount of water. The afterwash was carried out at 60° C., with a specific water consumption averaging about 15 l/kg of textile goods. This final afterwash was treated as an "economy wash", being so restricted that it was far from adequate for cleaning printed and fixed goods of the above type. Even a single treatment of the goods in accordance with the invention was insufficient to give satisfactory goods after this "economy afterwash". As can be seen from the lower, broken curve of FIG. 6, if material not treated according to the invention is subjected to this "economy afterwash", about 20% of the products applied (which in principle can be washed out) remain on the goods. Therefore, the white ground is bluish-grey in every case and in many places even a cloudy blue, and both the hand and the fastness characteristics are unsatisfactory. The "economy afterwash" produces a certain improvement after the first treatment according to the invention, but does not achieve any really noticeable improvement in the case of articles which are difficult to wash out, such as the very light-weight union fabric used in the present instance, and reconfirms the old prejudice that squeezing off is useless.

In the case of the goods treated twice, 3 times and 4 times in accordance with the invention, a subsequent "economy afterwash" produces no further significant increase in the total amount of material removed, indicating that the treatment according to the invention was already extremely effective. However, the "economy afterwash" does produce an improvement in fastness characteristics, by up to a whole figure of merit.

In the case of the goods treated two or more times in accordance with the invention, the "economy afterwash" not only gives satisfactory washing-out results, but also produces goods which have a very clear white background and a very soft, flowing hand.

In a further series of experiments, 1 g/l of a commercial dispersant based on the sodium salt of a condensation product of β-naphthalenesulfonic acid and formaldehyde was added to the fresh water and the procedure was again carried out at 20° C., as described above. This additive further improved the results described above.

EXAMPLE 2

A 50/50 cotton/polyester fabric weighing 100 g/cm$^2$ and having a substantially closer construction than the goods of Example 1 was used as a standard fabric.

Printing was carried out by the same process, and with the same print paste, as in Example 1. Once again, 70% of the goods was covered, and the total amount of solids applied was about 9% by weight.

The treatment according to the invention was carried out as in Example 1, ie. with cold water (20° C.), a rate of travel of 10 m/min and a wetting and swelling time of 3 seconds. The water consumption was about 3.5 l/kg of goods (the goods thus carried 350% of water). The interspace volume of the goods was 1.8 l/kg, so that in this case 1.7 l/kg (170% or 1:1.7) of externally carried water was present.

In this case, again, a deposit built up on the rollers, which again rapidly reached constancy and did not cause any running problems, even though it was not washed off continuously. The deposit was relatively easily removable with a moist sponge.

The waste water obtained after the 1st squeeze-off averaged 2.7 l/kg of goods, corresponding to 270%. This waste water contained 220 mg of dispersed dye per liter, according to a photometric determination.

Figure 4:
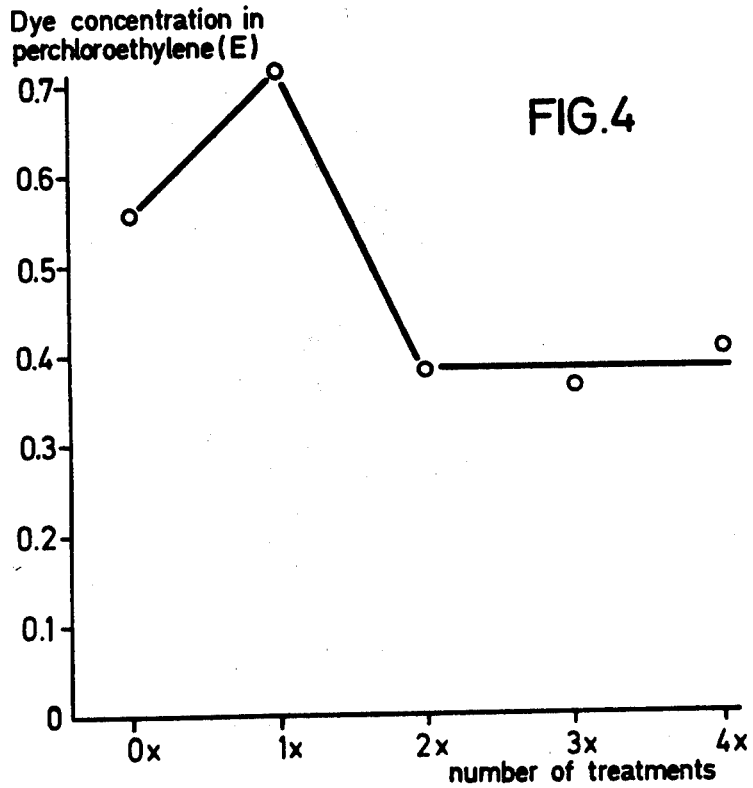

In spite of a total removal of material of 2.8% by weight, the goods again showed increased stiffening-up, with the bending length increasing from 2.6 cm (untreated goods) to 3.2 cm (goods treated once), and a substantially discolored white ground. The perchloroethylene test for unfixed dye gave a substantially lower value, even after this first treatment, than the value obtained with goods which had only been printed and fixed (E after printing=0.45, E after 1 treatment=0.28) and the absolute level was significantly better than that of the values obtained with the lightweight goods in Example 1 (FIG. 4).

The second treatment was carried out in accordance with the technique described in Example 1. 250% of water were separated off, ie. the waste water produced averaged 2.5 l/kg of goods. The content of insufficiently fixed disperse dye in the waste water was 210 mg/l, ie. almost as high as in the case of the first treatment according to the invention.

The total amount of material removed, as measured in terms of the change in weight per unit area, at this stage reached 7.5%. The stiffening decreased substantially (with a bending length decreasing from the previous value of 3.2 to 2.4 cm) and the white background showed no blotches whatsoever, but only a pale greyish blue hue. The perchloroethylene test indicated no further improvement; a conspicuous feature were the greater fluctuations of the values at this better level of removal of insufficiently fixed dye.

The process according to the invention was carried out twice more on the printed goods. This increased the total amount of material removed to 8.3% by weight, and the dye content of the waste water fell to 36 mg/l. Similarly, the whiteness of the ground improved, though it was already of a high level after the 3rd treatment.

In a variant of the process, a stiffer rubber wiper was mounted at the apex of the pattern-side roller of the horizontal padder, the roller was sprayed approximately tangentially from a spray tube at about 5 cm distance from the wiper, and the excess water was stripped off, at the bottom point of the roller, by means of a soft rubber wiper, and passed into a trough extending over the full width of the roller. The roller cleaning liquid was recycled. On the pressure side of the pump was provided a pressure monitor, followed by a restrictor (a narrower tube). As a result of the roller cleaning liquid becoming charged with thickener, the viscosity increased, resulting in an increase in the hydraulic pressure between the pump and the restrictor, so that the pressure monitor responded. This closed a contact which for 1 minute opened a draining valve and drained off cleaning liquid.

Fresh water or counter-current water was added, from a simple level-control system, so as always to maintain an approximately constant volume of cleaning liquid. The print thickener constituents which could be precipitated with acetone always amounted to more than 20 g/l in the cleaning liquid. Using the measures described above, the total amount of material removed increased by about 20%, and the amount of dye removed by about 30%, in the first treatment, when compared with a first treatment carried out under otherwise identical conditions, as described earilier.

An "economy afterwash" which proved unsuccessful in the case of untreated goods or goods treated only once in accordance with the invention, gave good results on goods treated twice and very good results on goods treated 3 or 4 times.

Using the installation with roller cleaning, even the goods treated only once gave adequate results after the "economy afterwash", with the white background only showing a faint greyish blue haze.

EXAMPLE 3

The same goods as in Example 2 were used, and the process was carried out similarly, but the goods had been printed and fixed by the one-step process. In addition, the print paste contained 60 g/kg of a solvation assistant.

It is true that using this method of fixing no dye was transferred into the wash liquor by the treatment according to the invention, but, surprisingly, the perchloroethylene test for unfixed dye gave substantially improved results:

untreated printed goods: E=0.582
goods treated once: E=0.42
goods treated twice: E=0.44
goods treated 3 times: E=0.43

The total amount of material removed is less in this instance, because of the selective application to the printed areas of the solubilizing agent. The total amount removed was a follows:

after the 1st treatment: 1.7% by weight
after the 2nd treatment: 3.9% by weight
after the 3rd treatment: 3.8% by weight
after the 4th treatment: 4.6% by weight The stiffness test again showed the characteristic pattern, namely an initial increase in stiffness, to which the prejudices against the process may be attributable, and only then an abrupt decrease in stiffness to values which were hardly improved by further treatments:

| Number of treatments according to the invention | Bending stiffness (bending length at (41.5°) |
|---|---|
| 0 × | 2.9 cm |
| 1 × | 3.3 cm |
| 2 × | 2.4 cm |
| 3 × | 2.3 cm |
| 4 × | 2.2 cm |

drawn out, dried in air and then weighed. The difference in weight between the printed area and the white background of the unprinted fabric was determined on 5×5 cm samples, of which 4 each were punched from the printed area and white ground.

During its dwell, which lasted from 5 to 120 seconds in the different variants of the process, the goods contained 70% by weight of water with the padder set to "medium" and 60% by weight with the padder set to "strong".

The amount of material carried by the goods in the printed areas was found to be 19% by weight, by comparing the weights per unit area of printed and unprinted areas. The print was of a deep color; the fabric was found to carry about 2.5% by weight of fixed dye and about 16% of total removable material.

Some variants of the process were next carried out. In each case the fabric was charged with 290% of liquor in the course of 1 second; it was then squeezed off to different degrees, left to dwell for different periods of time, recharged for dipping for one second and again squeezed off, with the same machine setting as for the first squeeze-off.

| | Water content of the squeezed-off goods | Dwell time | Total amount removed | White background after additional economy wash | Water separated off, % by weight |
|---|---|---|---|---|---|
| a | 70% | 5 sec. | 11% | good | 220 |
| b | 70% | 30 secs. | 10.5% | very good | 220 |
| c | 70% | 60 secs. | 9.7% | very good | 220 |
| d | 70% | 120 secs. | 8.4% | good | 220 |
| e | 70% | 240 secs. | 9.4% | good | 220 |
| f | 60% | 5 secs. | 7.5% | good | 230 |
| g | 60% | 120 secs. | 8.4% | good | 230 |

EXAMPLE 4

A cotton fabric weighing 143 g/m$^2$ was screen-printed with a reactive dye of the formula

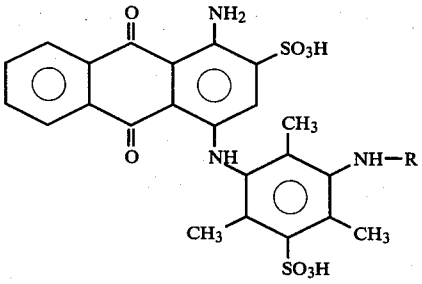

The main constituent of the print thickener was sodium alginate. The printed and fixed goods (fixing with steam for 8 minutes at 120° C.) exhibited a degree of cover of about 90% in the printed areas, and had an unprinted strip for comparative measurement purposes.

A piece of fabric 1 m long and 40 cm wide was used as the test material. A pattern was screen-printed over 30% of the length and over the entire width. The dry fabric was threaded between the rollers of a 50 cm wide laboratory padder, over a guide roller and over the trough roller, and the ends were joined by adhesive tape to form an endless belt. 2 liters of tap water (not containing any assistant) at about 20° C. were introduced into the padder trough. The fabric constantly travelled at 10 m/min, so that one revolution of the belt required 6 seconds. After the experiment, the belt was severed, The data show, in the first place, that with this system, in which washing out is very difficult, about half the removable substance is in fact removed by a double treatment.

The measurements show very clearly that shorter dwell times and a medium squeeze-off pressure (70% by weight wet pick-up) result in greater removal of thickener.

The results further show that at expensive squeeze-off pressures which, with these goods, give a wet pick-up of 60%, the dwell time has hardly any effect and the total amount of material removed is the same or less than under medium pressure.

A surprising effect achieved with the "economy after wash" in hot water was that the dye not fixed reactively was efficiently dissolved out of the white ground which was very heavily stained by the process according to the invention.

A comparison with untreated goods always gave the impression that the distribution, between the textile goods and the liquor, of the dye which had not been fixed reactively was substantially shifted in favor of the liquor as a result of the mechanical treatment of the process according to the invention. Evidently, in the case of reactive prints, the process according to the invention only removes a part of the unfixed dye from the goods; a small proportion is present on the white background but, surprisingly, dissolves very easily and substantially completely in hot water.

The economy afterwash increased the total amount removed from 14 to 15%.

The total amount removed was in each case determined by comparing the weight per unit area of the white ground and of the printed area. On a hot afterwash, the uprinted areas of the fabric shrank about 2% more than the areas carrying the reactive print; this was taken into account in the figures quoted.

We claim:

1. A process for continuously washing a printed textile sheet-like structure, wherein water or an aqueous wash liquor is applied to the sheet-like structure in open width so that it takes up from 80 to 500% by weight of water based on the weight of the sheet-like structure, and the sheet-like structure is then squeezed off against a squeeze roller or rollers so as to remove at least 30% by weight of water based on the weight of the sheet-like structure, whereby removable material on the surface of the sheet-like structure is sheared off from the sheet-like structure and is transferred to the squeeze roller(s), from which it is then removed.

2. The process of claim 1, wherein the material transferred from the sheet-like structure to the roller(s) is additionally removed mechanically and/or water is applied to the roller and the transferred material is thereby removed together with the water.

3. The process of claim 1 or 2, wherein the textile sheet-like structure is squeezed off against a squeeze roller to a wet pick-up of from 50 to 120% by weight, the percentages being based on the weight of the sheet-like structure.

4. The process of claim 3, wherein the charging of the textile sheet-like structure with water, and the squeezing off, is repeated one or more times.

* * * * *